US007357600B2

(12) United States Patent
Suazo et al.

(10) Patent No.: US 7,357,600 B2
(45) Date of Patent: Apr. 15, 2008

(54) WATER MANAGEMENT SYSTEM

(75) Inventors: Kenneth L. Suazo, Espanola, NM (US); Dawn S. Harder, Tijeras, NM (US)

(73) Assignee: Fast Ditch, Inc., Vallecitos, NM (US)

( * ) Notice: Subject to any disclaimer, the term of this patent is extended or adjusted under 35 U.S.C. 154(b) by 252 days.

(21) Appl. No.: 11/281,822

(22) Filed: Nov. 17, 2005

(65) Prior Publication Data

US 2006/0078389 A1 Apr. 13, 2006

Related U.S. Application Data

(60) Continuation-in-part of application No. 11/114,546, filed on Apr. 26, 2005, now Pat. No. 7,156,580, which is a continuation-in-part of application No. 10/837,213, filed on Apr. 30, 2004, now Pat. No. 7,165,914, which is a continuation-in-part of application No. 10/731,315, filed on Dec. 8, 2003, now Pat. No. 7,025,532, which is a division of application No. 10/453,673, filed on Jun. 3, 2003, now Pat. No. 6,722,818, which is a continuation-in-part of application No. 10/316,756, filed on Dec. 11, 2002, now Pat. No. 6,692,186.

(51) Int. Cl.
*E02B 5/02* (2006.01)

(52) U.S. Cl. ..... 405/118; 405/119; 405/121

(58) Field of Classification Search ..... 405/118, 405/119, 121

See application file for complete search history.

(56) References Cited

U.S. PATENT DOCUMENTS 3,156,099 A * 11/1964 Dailey ..... 405/121
3,854,292 A * 12/1974 Nienstadt ..... 405/270
6,273,640 B1 8/2001 Suazo
6,692,186 B1 2/2004 Suazo et al.
6,722,818 B1 4/2004 Suazo et al.
6,766,817 B2 7/2004 Silva
7,025,532 B2 * 4/2006 Suazo et al. ..... 405/121
7,156,580 B2 * 1/2007 Suazo et al. ..... 405/121
7,165,914 B2 * 1/2007 Suazo ..... 405/121

* cited by examiner

*Primary Examiner*—Frederick L Lagman
(74) *Attorney, Agent, or Firm*—Ray R. Regan

(57) ABSTRACT

A water management system includes a series of corrugation couplers adapted for compressibly connecting and detaching liner sections end to end. Each corrugations coupler is included in successively formed corrugation segments. Each corrugation segment includes two adjacent corrugations, a leading corrugation, and a trailing corrugation. The leading corrugation is formed with a substantially triangular cross-section having a rounded apex (the "extended corrugation"); the trailing corrugation in a corrugation segment is formed with a substantially frustoconical cross-section having a height less than the height of the extended corrugation (the "shortened corrugation"). Also included is a connector for contributing to interconnecting liner sections end-to-end. A compressibly resilient gasket is included for contributing to sealing the liner sections. This abstract is provided to comply with rules requiring an abstract that will allow a searcher or other reader to quickly ascertain the subject matter of the technical disclosure, but this abstract is not to be used to interpret or limit the scope or meaning of any claim.

19 Claims, 9 Drawing Sheets

WATER MANAGEMENT SYSTEM

CROSS-REFERENCE TO RELATED APPLICATIONS

This application is a continuation-in-part from continuation-in-part application, application Ser. No. 11/114,546, filed Apr. 26, 2005, now U.S. Pat. No. 7,156,580 which is a continuation-in-part application from application Ser. No. 10/837,213, filed Apr. 30, 2004, now U.S. Pat. No. 7,165,914 which is a continuation-in-part application of application Ser. No. 10/731,315 filed Dec. 8, 2003, now U.S. Pat. No. 7,025,532 which was a divisional application of application Ser. No. 10/453,673 filed on Jun. 3, 2003 that matured into U.S. Pat. No. 6,722,818 B1 issued on Apr. 20, 2004, which itself was a continuation-in-part of parent U.S. application Ser. No. 10/316,756 filed Dec. 11, 2002 that matured into U.S. Pat. No. 6,692,186 B1, issued Feb. 17, 2004. With the exception of application No. 11/114,546 the specification and disclosures of the foregoing documents are incorporated by reference into this document.

FIELD OF TECHNOLOGY

The water management system disclosed and claimed in this document pertains generally to transportation of water and other fluids and materials. More particularly, the new and useful invention claimed in this document pertains to a ditch liner system for conveying either desirable or undesirable fluids, including not only desirable fluids such as water, but also fluid mixtures and admixtures containing undesirable solids, gases, trash, dirt, toxins, contaminants, and a wide range of other solids, fluids, gases and other undesirable matter (collectively, in this document, "fluids and materials") through the water management system. The apparatus and methods disclosed and claimed in this document are particularly, but not exclusively, useful for rapidly yet reliably assembling and disassembling a water management system using the unique corrugation couplers disclosed and claimed in this document. More particularly, the new and useful water management system provides an inexpensive, light, portable, light-resistant, ultra-violet resistant, inter-connectable system of liner sections that, when assembled, transport fluids and materials through the system while reducing water loss.

BACKGROUND

Ditches formed in the earth for conveying water to a point or to an area of use have been common throughout the world for generations. Earthen ditches have been used to transport potable water, irrigation water and other fluids and materials. Earthen irrigation ditches continue to be significant in the transportation of water because they are readily and inexpensively formed in almost any terrain.

The term "ditch" as used in this document means any excavation dug in the earth, or any structure partially or completely installed above earth, that may be referred to as a drain, channel, canal or acequia, whether lined or unlined, usually but not always relying primarily on gravity to transport fluids and materials along descending elevations.

During transportation of water through earthen ditches that are unlined by a material other than dirt ("unlined ditches"), significant quantities of that ever more precious commodity, water, are lost because of seepage, erosion, trans-evaporation and other causes. Tests indicate that as much as 80-90% of water may be lost during transportation through an unlined earthen ditch before water is delivered to a point or area for application and use.

It also should be appreciated that loss of water, referred to as "seepage loss," may be considerable. At least one report issued by New Mexico State University entitled "Field/laboratory Studies for the Fast Ditch Lining System," dated Feb. 10, 2002 ("Report"), indicates the results of tests conducted over a nine day interval. Total water losses during the nine-day test period were estimated to be 14,245,010 gallons, or 85.8% of total flow, when water was conducted through an unlined earthen ditch. The Report attributes most water losses to existing vegetation overgrowth, tree root systems, gopher holes, evaporation, and seepage or percolation. On the other hand, that same report, based on field measurements taken with a liner system disclosed in at least one of the Fast Ditch Patents and Applications (a term defined below) that had been installed in the same earthen ditch showed a total loss of only 7.3% of total flow.

Unlined earthen ditches must regularly be maintained, cleaned and repaired to avoid loss of water through wall collapse, accumulated debris, absorption through dirt walls, capillary action, rodent activity, among many causes of ditch deterioration. Because repair and maintenance of unlined ditches is costly and labor intensive, various methods for lining unlined ditches have been suggested. Those methods include use of concrete, metal, and polyvinyl chloride materials. Those suggestions, however, have proven inadequate for a number of reasons including at least cost and unresponsiveness to modern environmental concerns. Some materials, like concrete, are difficult to install in remote geographical areas, are inflexibly positioned once installed, and often require major construction efforts that are neither practical nor affordable based on cost-benefit analyses.

Exemplary solutions to problems associated with lining both lined and unlined ditches have been provided in the following patents and patent applications by one or more of the inventors named in connection with this document: U.S. Pat. No. 6,273,640 B1 issued Aug. 14, 2001; U.S. Pat. No. 6,692,186 B1 issued Feb. 17, 2004; U.S. Pat. No. 6,722,818 issued Apr. 20, 2004; U.S. application Ser. No. 10/731,315 filed Dec. 8, 2003; U.S. application Ser. No. 10/837,213 filed Apr. 30, 2004; and U.S. application Ser. No. 11/114,546 filed Apr. 26, 2005 (collectively, "Fast Ditch Patents and Applications").

The Fast Ditch Patents and Applications, and this document, describe and claim apparatus that provide ditch liner sections that are inexpensive, light, portable, light-resistant, and ultra-violet resistant. The Fast Ditch Patents and Applications, and this document, also describe and claim liner sections that are easily inter-connectable and, when assembled, are capable of transporting desirable and undesirable fluids and materials through the liner sections quickly and efficiently. The liner sections may be installed using simple, conventional tools such as a shovel, cordless drill, rubber mallet and sledge hammer. When installed the liner sections are substantially maintenance free. In an installation in which the flow of fluids and materials is approximately 2.00 feet per second, the assembled liner sections are self-scouring. The liner sections are corrugated, and at least one additional mechanical advantage thus provided is flexibility of interconnected liner sections to accommodate the contours of an existing ditch, whether lined or unlined. The corrugations also allow an installed water management system to flex during freeze-thaw fluctuations. The liner sections also are environmentally safe, nontoxic, and recyclable because made of selective plastics. At least one plastic used to manufacture the liner sections is Nora Chemicals NOVA POL® TR-0535-UG Hexene MDPE. The Fast Ditch Patents and Applications describe and claim liner sections that reduce loss of desirable fluids during such transportation.

As indicated, use of concrete to line ditches has proven particularly problematic. Since the advent of concrete and other building materials made by mixing a cementing material such as Portland cement with both a mineral aggregate such as sand and gravel, and sufficient water to cause the cementing material to set and bind the entire mass, concrete and similar materials have been used to line earthen ditches.

Originally it was thought that concrete lined ditches would avoid loss of water through seepage through the concrete into the underlying earth. Experience has demonstrated, however, that whether freestanding or moving, fluids seep into, against, and under concrete concrete-lined ditches. This adversely affects commercial and residential structures, and causes loss of desirable fluids such as irrigation water. Unfortunately, concrete also has inherent brittle tendencies to crack. It is difficult to repair in remote and challenging terrain due in part to the substantial weight of concrete, and the weight of hauling and installing equipment and vehicles. Concrete repairs also may disrupt landscapes due to the heavy equipment needed to haul and emplace concrete. Accordingly, corrosion mitigation in connection with concrete used for lining ditches has been a significant goal, but difficult to achieve.

At least one reason for difficulty in corrosion mitigation in concrete lined ditches is the fact that concrete drains manufactured from Portland cement and various aggregates are subject to deleterious damage caused at least in part by alkali-silica reactivity ("ASR"). ASR is a chemical reaction between Portland cement concrete and aggregates that in some environments, and under some conditions, may cause severe damage to concrete ditches. ASR also may expedite other reactions that in turn cause damage, such as freeze-thaw or corrosion related damage. The phenomenon has been recognized since at least 1940, but neither the mechanisms of ASR, nor solutions, yet are clearly understood.

It is known, however, that deterioration of a concrete structure such as a concrete-lined ditch is due at least in part to water absorption by a gel that forms in concrete. The term "gel" as used in connection with concrete fabrication refers to a naturally occurring silica gel that is a colloidal silica resembling course white sand, but has many fine pores, a condition that causes the gel to be extremely adsorbent. Soluble alkalis also are present in cement, and may be affected by undesirable moisture. Vulnerable sites in the silica structure may be attacked by fluid-induced activity, converting the silica to a silica gel that absorbs water or other fluids.

An important property of concrete is its tensile strength, or its ability to react to longitudinal stress. Liquids, however, are known to adversely affect tensile strength in concrete. If the tensile strength of concrete is exceeded, cracks will form and propagate from one or more alkali-silica reaction sites, weakening the concrete structure. Many if not all the problems generally associated with ASR may be seen in concrete-lined ditches that have been constructed in situ for any length of time. In addition, concrete is becoming ever more expensive due to international demand occasioned by countries that until recently lagged construction activities in the United States and Europe; indeed, at the time of this document, shortages in Portland cement and concrete have been reported.

Concrete also has several additional limitations and deficiencies as a liner material for earthen ditches. Material characteristics of concrete are not consistent, and usually are not even consistent within the same ditch line. Concrete ditch liners also react adversely to changes in ambient temperatures, and to rapidly altering hot and cold cycles. Concrete is subject to cracking due to temperature changes. If moisture penetrates cracks in concrete, a concrete lined ditch is subject to further cracking. Slight cracks tend to expand into large cracks as frost and thaw cycles proceed through a typical year. In the end, concrete lined ditches are subject to possible catastrophic failure. As a result, significant amounts of water may be lost when transported through concrete lined ditches. Significant quantities of water are lost because of seepage, erosion, trans-evaporation and other causes.

Concrete lined ditches also must regularly be maintained, cleaned and repaired to avoid further loss of water through wall collapse, accumulated debris, newly formed cracks and deterioration of the base and walls of concrete due to the continued effects of weather. Repair and maintenance of concrete lined ditches is costly and labor intensive. Patching concrete is expensive, labor intensive, and difficult to achieve given the remote location of most ditches, particularly agricultural ditches used to transport irrigation water. The repair problems associated with concrete lined ditches present major construction efforts that often are neither practical nor affordable. Therefore, many concrete ditches continue to deteriorate, resulting in increased loss of water. Inability to readily direct and redirect water flow to other ditches or in other directions using concrete or steel also is a significant limitation on their use.

In recent years, efforts have been made to develop methods to seal cracked concrete lined ditches. A variety of mortars and sprayed-on resins and plastics have been suggested. Unfortunately, both mortar and spray-on resins and plastics have proven inadequate solutions because of comparatively disadvantageous costs involved in the materials and applications processes, and because of labor costs associated with direct application of such materials at the site of a concrete lined ditch, regular often remote from where such materials are available.

Further optimizations in connection with the Fast Ditch Patents and Applications are achieved as disclosed and claimed in this document by providing alternative features and desirable elements for increasing the range and variety of differing applications and environments in which the water management system may be used.

For example, the mating, nesting, or connectable ends of liner sections in accordance with the Fast Ditch Patents and Applications allow compressible connection of liner sections end-to-end. This is achieved by providing for opposing male and female structural elements and components whose dimensions and shapes vary (collectively, "dimensionally different compressible components"). The Fast Ditch Patents and Applications also provide for liner sections whose corrugations vary in shape and configuration between opposing ends of a liner section. For example, U.S. Pat. No. 6,722,818 provides for a compressibly connectable member formed in the downstream end of a liner section. A coupling channel is formed in the upstream end of a liner section. Both the compressibly connectable member and the coupling channel are dimensioned to be substantially double the thickness of an intermediate body between the compressibly connectable member and the coupling channel in which corrugations are formed.

While the apparatus disclosed and claimed in U.S. Pat. No. 6,722,818 has proven ideal in a variety of situations and installations, the different compressible components present manufacturing and molding complexities, and thus increase costs associated with manufacturing the liner sections. Additional costs are incurred in fabricating tools and dies due to the differing compressible components. Performing quality control procedures to ensure that the different compressible components of manufactured liner sections are dimensionally accurate also increases costs. Manufacturing processes for liner sections also must provide a variety of tools and dies to accommodate the need for manufacturing differing lengths of liner sections to fit a ditch liner section system into varying lengths of ditches. In addition, during field assembly of the liner sections into a complete liner system, installers must be aware of structural differences between opposing connectable ends of liner sections. Installers must also have a variety of differing lengths of liner sections to match the lengths of an existing lined or unlined ditch. There also is a need for comparatively smaller dimensioned liner sections that may be used not only for transporting desirable or undesirable fluids and materials, but also for landscaping.

The water management system disclosed in this document solve the foregoing complexities and needs.

Thus, the water management system disclosed and claimed in this document addresses the need for proportionately and comparatively smaller dimensioned ditch liner sections that may be assembled for a variety of uses including water transportation, storm management, irrigation, and landscape uses. The water management system also includes new and useful corrugation couplers that may be applied to a wide range of ditch liner sections having a variety of cross-sectional shapes and configurations, as well as a variety of dimensional variations. The unique corrugation couplers also allow assembly of a water management system in any lengths by allowing an installer, during field assembly of a liner system, to trim excess lengths of corrugations from ditch liner sections while retaining the capability of locking ditch liner sections of any length together because of the unique corrugation couplers. Use of the corrugation couplers reduces the costs and complexities of manufacturing liner sections by eliminating dimensionally different compressible components at opposing ends of liner sections.

The additional optimizations shown and claimed in this document also provide a new and useful water management system that results in an inexpensive, light weight, portable, light-resistant, ultra-violet resistant, inter-connectable system of liner sections that, when assembled, transport either desirable or undesirable fluids and materials through the system while reducing water loss during use of the system.

SUMMARY

The water management system insertable into a lined or unlined ditch is an inexpensive, light weight, portable, light-resistant, ultra-violet resistant, inter-connectable system of liner sections that, when assembled, transport either desirable or undesirable fluids and materials through the system while reducing water loss during use of the system. The water management system also is aesthetically pleasing in the operative environment, is environmentally friendly, and requires no unique skills to assemble, install, and maintain. The water management system enhances flow rates through the system while significantly reducing water loss during transportation of water through a system of ditch liners.

The water management system disclosed and claimed in this document includes a plurality of ditch liner sections (individually, "liner section," and collectively, "liner sections"). Each liner section of the water management system may be assembled end-to-end to another liner section by snapping together, or compressing together, the unique corrugation couplers formed in the corrugations in each liner section. The terms "snap together," or "compressibly connectible," and variations of those terms as used in this document, refer to the feature and capability of applying pressure on one corrugation coupler to connect it to another corrugation coupler, thus compressibly locking, nesting, and connecting liner sections together, end-to-end, to form a substantially leak-free water management system whose individual liner sections are detachable.

The water management system also includes an elastically deformable gasket that contributes to a watertight, leak-free connection between interconnected liner sections, while enhancing the flow of water through the system.

The water management system overcomes undesirable effects of friction between (i) a boundary of a moving body of water in contact with, and moving through a ditch liner system, and (ii) the inner surface of the improved ditch liner. The term "friction" as used in this document means the force of resistance caused by one surface on another. Forces of resistance tend to prevent or retard slipping or movement of the water along a ditch liner. Forces of resistance may also cause damage to a ditch liner and to a ditch liner system.

As is known to those skilled in the art, forces of resistance tend to act tangentially to a surface at points of contact with the surface. Further, the force is a function of, or proportional to, the normal force, and is expressed as the "coefficient of static friction" in a stationary body, or "coefficient of kinetic friction" in a moving body. A coefficient of friction is a dimensionless number that depends on characteristics of the contacting surfaces, or in this instance, the characteristics of the boundary of a moving body of water, and the contact surface of the improved ditch liner. It is known that the coefficient of friction varies with temperature, humidity, pressure, the materials in contact, the sliding velocity of the body moving in relation to a surface, and whether the body and surface are dry or lubricated. It also is known to those skilled in the art that when two surfaces, or a boundary and a surface, move relative to each other, a lateral force is required to overcome adhesion, a force is referred to as "adhesional friction force." It also is known that the contacts between surfaces moving relative to each other depend primarily on the surface topography and the mechanical properties of the mating surfaces.

To overcome undesirable results of such forces and coefficients, studies and experimentation confirmed the usefulness of reconfiguring the radial geometry of corrugations in the improved ditch liner system discussed and claimed in this document. The novel corrugation couplers formed in the corrugations of the water management system improve flow efficiency by altering undesirable coefficients, including the Manning resistance coefficients. Lowering the Manning resistance coefficients by use of the arc-and-ridge corrugations of the water management system was an unexpected result.

To achieve a substantially zero-loss, watertight seal between connected ends of liner sections, corrugations extend substantially the entire length of each liner section. The material used to manufacture each liner section is the same; restated, different materials are not combined to make liner sections. In part to reduce costs associated with manufacturing the improved water management system, the process of manufacturing used to make the liner sections is a rotational molding process.

The water management system also includes opposing aprons that extend from opposing edges of the liner sections.

The opposing aprons are useful not only for reducing erosion and seepage adjacent the ditch, but for inserting anchors that secure liner sections in place.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the water management system will become apparent to those skilled in the art when read in conjunction with the following description, drawing figures, and appended claims.

The foregoing has outlined broadly the more important features of the invention to better understand the detailed description that follows, and to better understand the contributions to the art. The water management system is not limited in application to the details of construction, and to the arrangements of the components, provided in the following description or drawing figures, but is capable of other embodiments, and of being practiced and carried out in various ways. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the water management system, which is measured by the claims, nor intended to limit the scope of the claims. The novel features of the water management system are best understood from the accompanying drawing, considered in connection with the accompanying description of the drawing, in which similar reference characters refer to similar parts, and in which:

DETAILED DESCRIPTION

Figure 1B:
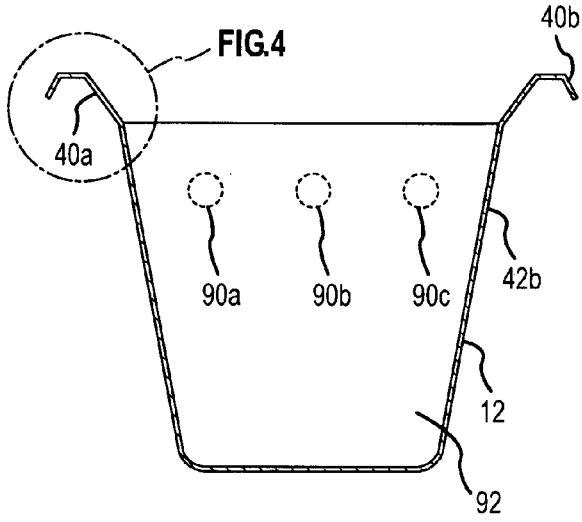
FIG. 1B is an end cross-sectional view of the liner section shown in FIG. 1A showing opposing aprons and one form of a diversion device.

As shown in FIGS. 1A-6E, a water management system 10 is provided that in its broadest context includes a plurality of compressibly connectable liner sections for lining a ditch. The plurality of compressibly connectable liner sections is formed with corrugations. A plurality of corrugation couplers is formed in the corrugations for connecting the plurality of liner sections end-to-end. The plurality of corrugation couplers includes a monolithically formed succession of adjacent extended corrugations and foreshortened corrugations. The water management system also includes means for sealing abutting corrugation couplers. Also included is a connector such as a threaded rivet for affixing adjoining corrugation couplers. An anchoring device insertable through the plurality of compressibly connectable liner sections is provided for securing the water management system in the ditch.

The extended corrugations include a substantially triangular ridge having a rounded apex. The foreshortened corrugations include a substantially frustoconical ridge having a planar surface. A trough adjacently connects the extended corrugations and the foreshortened corrugations. Wells may be formed in the troughs for positioning connectors such as threaded rivets. A means for sealing abutting corrugation couplers is mountable on the planar surface of the substantially frustoconical ridge. In one embodiment, the means for sealing abutting corrugation couplers is a compressibly resilient gasket for sealing the plurality of compressibly connectable liner sections. An adhesive is placed on the planar surface of the foreshortened corrugations.

In one embodiment of the water management system, the slopes of opposing walls of the extended corrugations and of the foreshortened corrugations are substantially similar. The dimensions of opposing walls of the foreshortened corrugations would be substantially similar to the dimensions of opposing walls of the extended corrugations if not subtended by the planar surface of the foreshortened corrugations.

The water management system also includes a variety of water and material diversion devices.

In this description, to the extent that subscripts to the numerical designations include the lower case letter "n," as in "a-n," the letter "n" is intended to express a large number of repetitions of the element designated by that numerical reference and subscripts.

MEANING OF SELECTED TERMS

"Management"

The terms "management" and "managing" used in conjunction with the word "water" (such as, "managing water," "water management," and similar variations of the terms) contemplate that the apparatus and methods disclosed and claimed in this document may be used to hold and irrigate plant and planting materials so as to conserve water; and that restrains growth of roots, shrubs and trees by confining growth within the apparatus and system disclosed and claimed in this document ("water management system"). The term "water management system" also contemplates and includes transporting fluids and materials within interconnected liner sections to specific points and areas. As shown in another embodiment, the water management system also may be used to route rain or undesirable water and materials away from land and structures.

"Corrugation Coupler"

The term "corrugation coupler" or "corrugation couplers" means and refers to the new and useful apparatus disclosed and claimed in this document for snapping together and separating, or compressibly connecting and detaching, liner sections into a water management system. The corrugations formed in the liner sections are themselves the corrugation couplers. The corrugations themselves are formed for compressibly connecting and detaching the liner sections end to end, resulting in reduction of manufacturing complexity and ease of field assembly of a water management system.

Figure 1A:
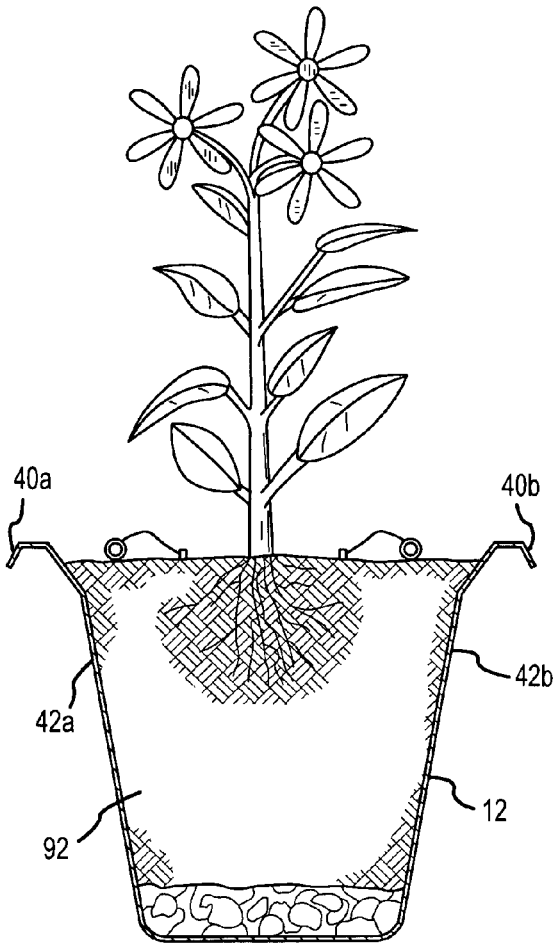
FIG. 1A is an end cross-sectional view of one embodiment of a liner section used in the water management system as used in a landscaping environment.
Figure 2:
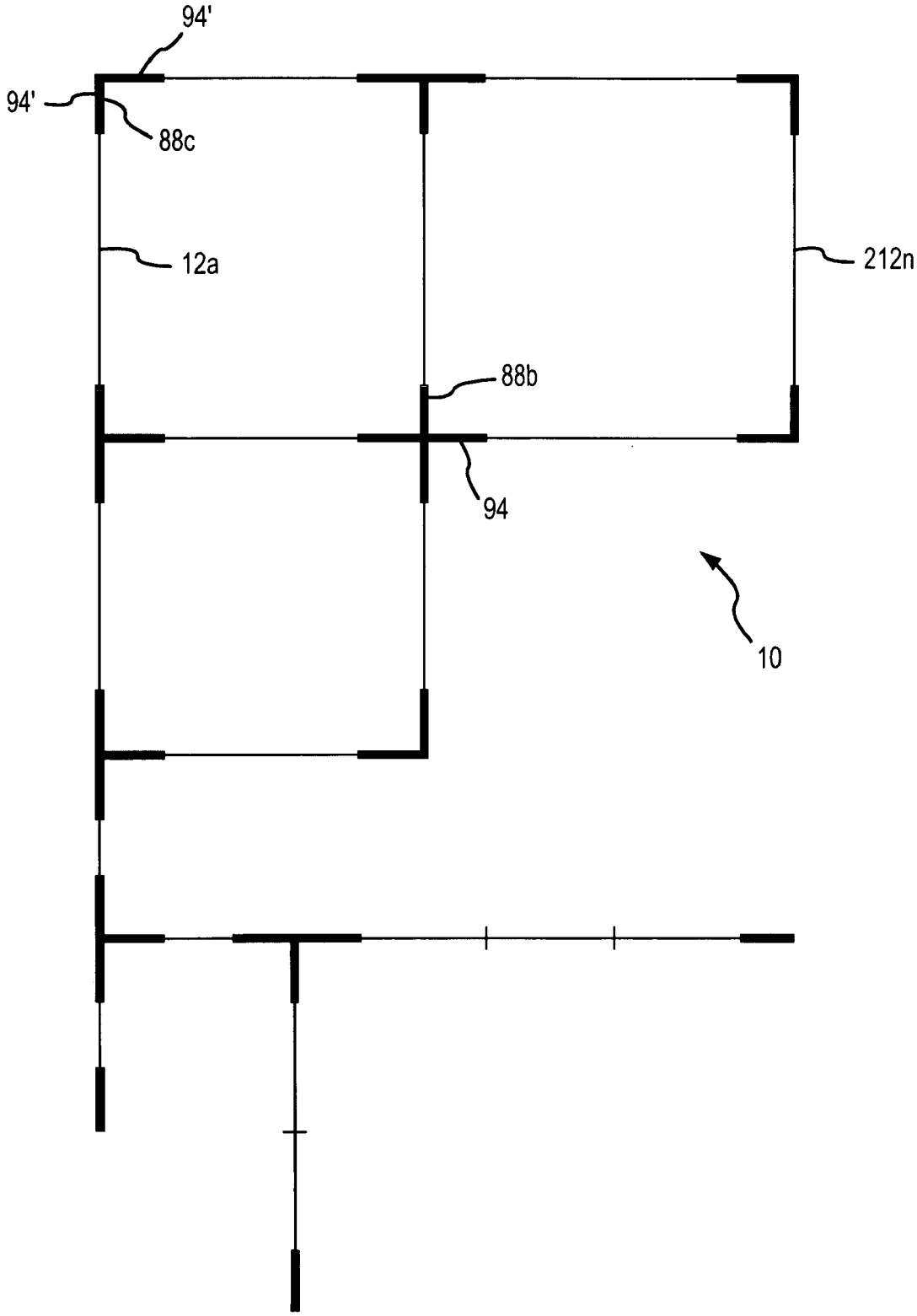
FIG. 2 is a diagrammatic representation of one embodiment of the water management system deployed as a landscaping water management system.
Figure 3:
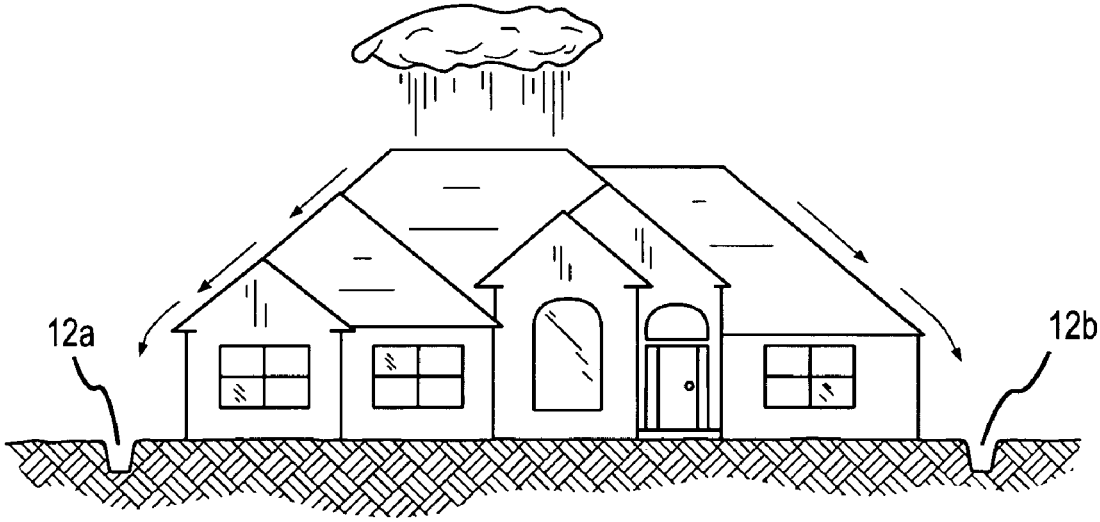
FIG. 3 is a diagrammatic representation of another embodiment of the water management system displayed as a storm water transportation system.
Figure 5A:
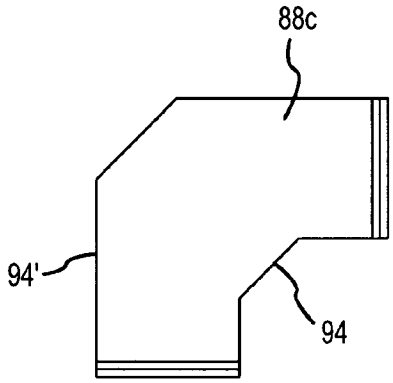
FIGS. 5A-5C are top views of three embodiments of diversion devices.
Figure 5B:
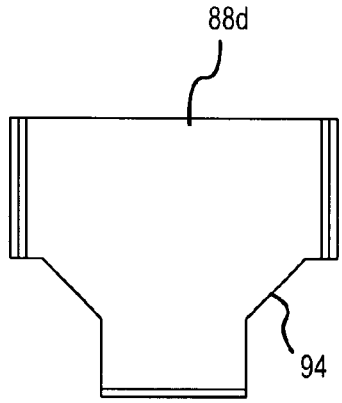
Figure 5C:
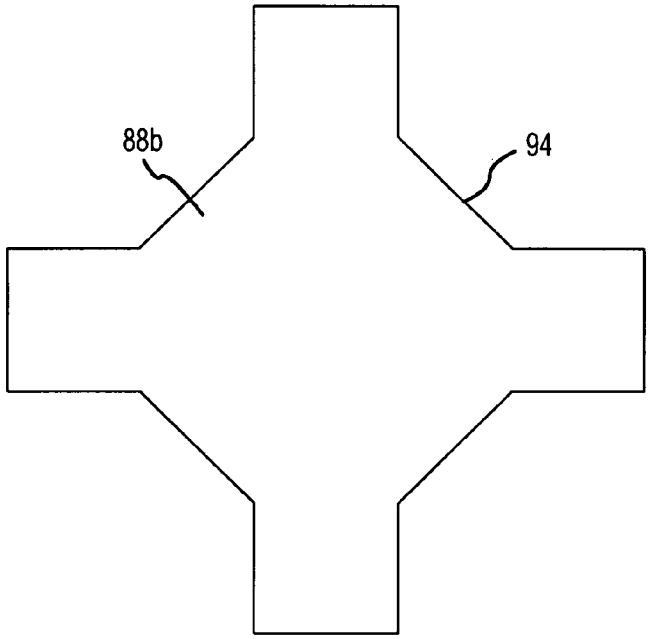
Figure 6A:
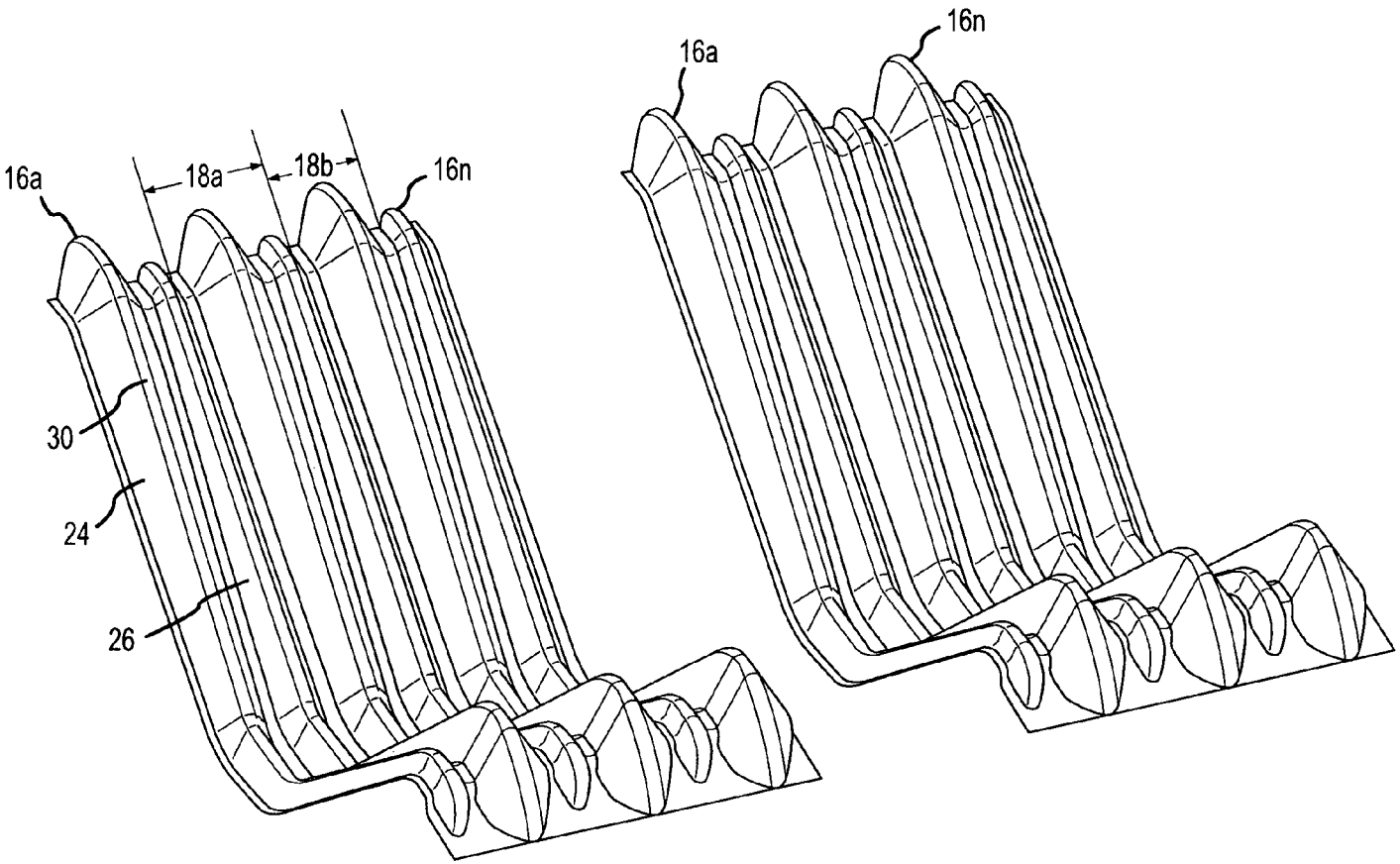
FIG. 6A is a perspective view of a portion of two liner sections showing the corrugation couplers.
Figure 6B:
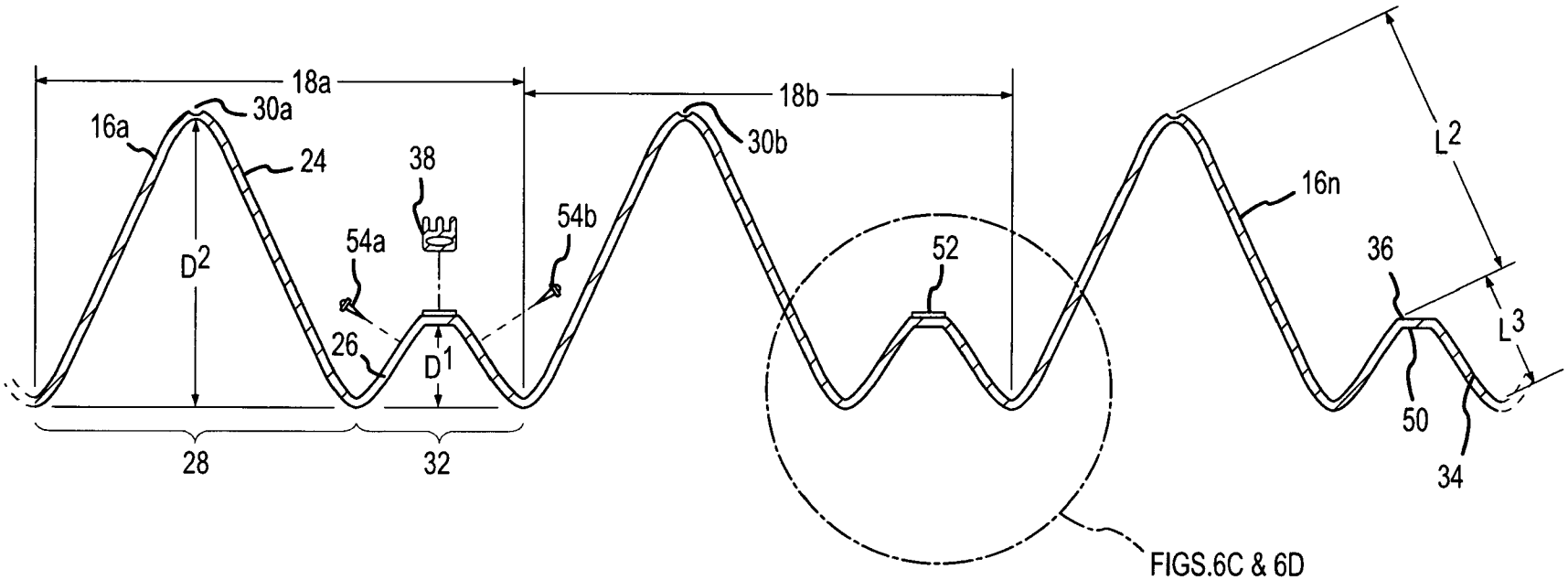
FIG. 6B is an end cross-sectional view of one embodiment of the corrugation couplers, connectors, and means for sealing.
Figure 6C:
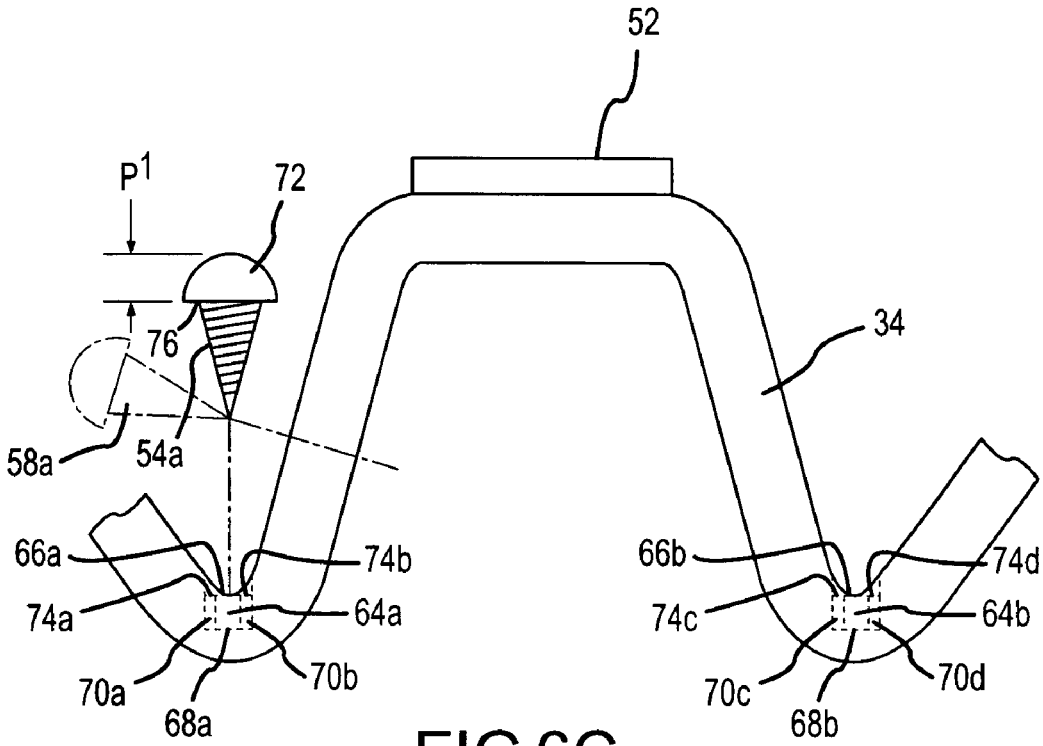
FIG. 6C is an end cross-sectional view of troughs on either side of a foreshortened corrugation.

More specifically, as shown by cross-reference between FIGS. 1A-6E, a water management system 10, as shown diagrammatically in FIG. 2, includes a plurality of compressibly connectable liner sections 12*a,b* for lining a ditch 14 as further shown by cross-reference between FIGS. 6A-6C. The plurality of compressibly connectable liner sections 12*a,b* is formed with corrugations 16. A plurality of corrugation couplers 18*a-n* as shown in FIGS. 6A-6B is formed in the corrugations 16*a-n* for connecting the plurality of liner sections 12*a,b* end-to-end. To achieve rapid, secure, repetitive connections, the plurality of corrugation couplers 18*a-n* includes a succession of contiguous extended corrugations 20*a-n* and foreshortened corrugations 22*a-n*. Thus, it will be apparent that each liner section 12*a-n* includes a monolithically formed succession of corrugations of varying dimensions. As shown, corrugation couplers 18*a-n* includes two adjacent corrugations 16*a-n*, a leading corrugation 24, and a trailing corrugation 26. The leading corrugation 24 is formed with a substantially triangular cross-section 28 having a rounded apex 30 (the "extended corrugation"); the trailing corrugation 26 is formed with a substantially frustoconical cross-section 32 having a height $D^1$ less than the height $D^2$ of the extended corrugation (the "foreshortened corrugation"), as best shown in FIG. 6B.

The walls 34 of the corrugations 16*a-n* are substantially of uniform thickness throughout the length $L^1$ of a liner section 12 as best shown in FIG. 6C. As will be evident to one skilled in the art, the length $L^2$ of extended corrugations 20*a-n* exceeds length $L^3$ of foreshortened corrugations 22*a-n* throughout the length $L^1$ of liner sections 12*a-n*, as shown by cross-reference between FIGS. 6B-6E. However, a mechanical advantage of the corrugation couplers 18*a-n* is flexibility in altering the dimensions of the corrugation couplers 18*a-n* during the manufacturing process, particularly the extended corrugations 20*a-n* and the foreshortened corrugations 22*a-n*, as dictated by the terrain conditions, size of the ditch 14 to be lined, and other varying conditions in which the water management system 10 will be installed, as well as other installation objectives. Thus, although the general dimensions of the extended corrugations 20*a-n* and foreshortened corrugations 22*a-n* remain collectively substantially constant throughout the length $L^2$ of each liner section 12*a-n*, the lengths $L^2$ and $L^3$ of the walls 34 of contiguous corrugations 16*a-n* may be varied from application to application, and installation to installation, depending also on terrain conditions and flow geometries desired for a particular water management situation.

As shown in FIG. 6B, except for heights $D^1$ and $D^2$, other dimensions of the foreshortened corrugations 22*a-n* may be substantially comparable to analogous dimensions of the extended corrugations 20*a-n*. This, too, contributes a mechanical advantage to forming the corrugations 16*a-n* during the manufacturing process: only the desired height $D^2$ of the foreshortened corrugations 22*a-n* need be altered because the other dimensions will be similar to the extended corrugations 20*a-n*. The height $D^1$ of the foreshortened corrugations 22*a-n* may be adjusted prior to the manufacturing process that produces the desired liner sections 12*a-n*. The planar surface 36 formed in the foreshortened corrugations 22*a-n* by the truncating of the foreshortened corrugations 22*a-n* also provides a surface on which to place an elastically deformable gasket 38 to help seal the connection between compressibly connected liner sections 12*a-n*.

As will be evident to one skilled in the art, the corrugation couplers 18*a-n* also may be used in a variety of liner sections 12*a-n* regardless of cross-sectional shape of the water management system 10 installed, including without limitation liner sections 12*a-n* where cross-sections are substantially semi-circular, trapezoidal, square, oblong, or "V"-shaped.

Thus, liner sections 12*a-n* may be manufactured in fewer "standard" lengths because one or more corrugation couplers 18*a-n* may be removed or incised from a liner section 12 to link liner sections 12*a-n* for a precise fit in a ditch 14, regardless of the length of the ditch 14. Because the corrugation couplers 18*a-n* are part of the corrugations 16*a-n* common to a water management system 10 installation, much greater installation precision is achieved.

Figure 4:
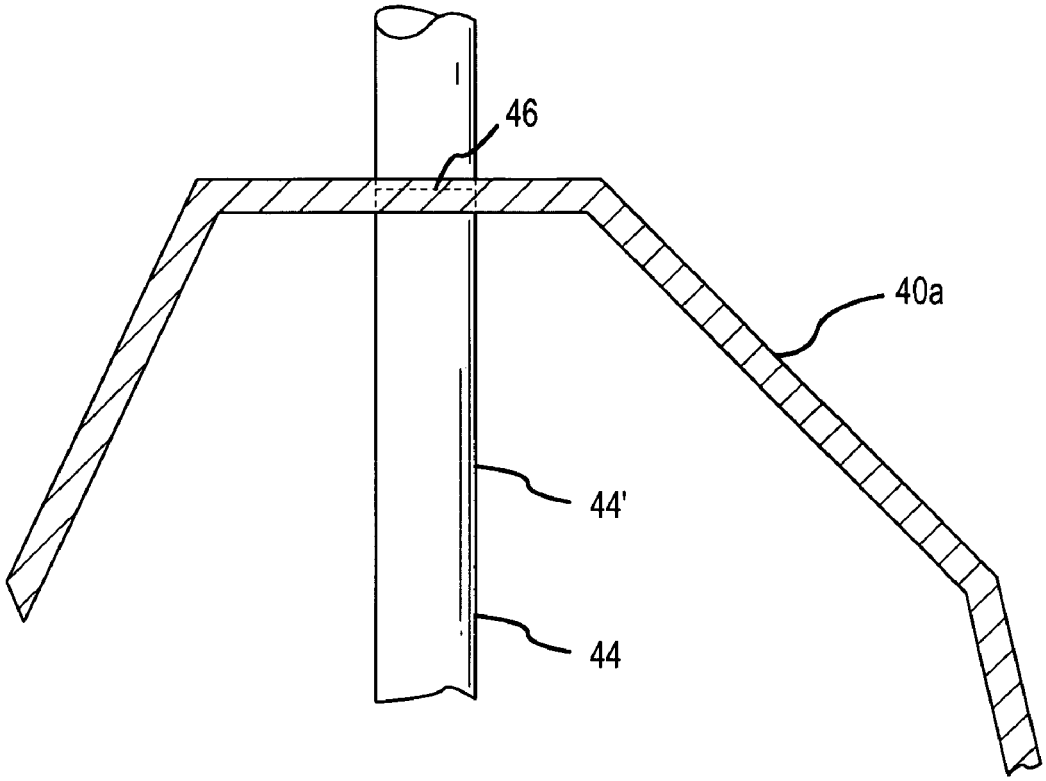
FIG. 4 is an end cross-sectional view of one embodiment of the opposing aprons.

As shown in FIGS. 1A-1B and 4, the water management system 10 also includes in at least one embodiment opposing aprons 40*a-b*. The opposing aprons 40*a-b* extend from opposing sides 42*a,b* of the compressibly connectable liner sections 12*a-n*. The opposing aprons 40*a-b* are useful in reducing erosion. Opposing aprons 40*a,b* also are useful in guiding installation of the anchoring device 44. As shown best in FIG. 4, opposing aprons 40*a-b* include, in one embodiment, a scribe line or indent 46 for guiding placement of an anchoring device 44 through the opposing aprons 40*a-b*.

The water management system 10 also includes in at least one embodiment, as shown by cross-reference between FIGS. 6A-6B, means for sealing 48 abutting corrugation couplers 18*a-n*. In the embodiment shown in FIG. 6B, means for sealing 48 abutting corrugation couplers 18*a-n* is mountable on the planar surface 36 of the substantially frustoconical ridge 50. As shown, means for sealing 48 abutting corrugation couplers 18*a-n* includes a compressibly resilient gasket 38. In another embodiment means for sealing 48 abutting corrugation couplers 18*a-n* includes an adhesive 52 to secure the compressibly resilient gasket 38 on the planar surface 36. The adhesive 52 is shown in FIG. 6B diagrammatically as a rectangle on planar surface 36.

As also shown in FIG. 6B, the water management system 10 also includes a connector 54 such as a threaded rivet. The connector 54 is useful for affixing adjoining corrugation couplers 18*a-n*.

As also shown in the embodiment shown in FIG. 4, the water management system 10 also includes an anchoring device 44 insertable through the plurality of compressibly connectable liner sections 12*a-n*, preferably the opposing aprons 40*a-b*, for securing the water management system 10 in the ditch 14. As shown in FIG. 4, the anchor is a rod. Alternatively, the anchoring device 44 may be an earth 44' anchor as described in U.S. patent application Ser. No. 11/114,546 filed on Apr. 26, 2005.

In the embodiments shown in FIGS. 1B and 5A-5C, the water management system 10 further includes one or more diversion devices 56*a-n*. A diversion device 56*a* shown in the embodiment in FIG. 1B includes one or more removable caps 58*a-c* located in one or more barrier ends 60 that may be formed or inserted in an end of a liner section 12. The one or more removable caps 58*a-c* located in one or more barrier ends 60 are formed to be easily removable from barrier end 60 by tapping with a light hammer or similar instrument. The holes remaining in the one or more barrier ends 60 permits movement and transport of water and other materials through an interconnected water management system that may be used for either, or both, fluid transportation alone, or fluid transportation through earth or similar materials placed in a water management system 10 used for landscaping purposes.

In the embodiments shown diagrammatically in FIGS. 5A-5C, a diversion device 56*b* includes a hub 62 shown diagrammatically in FIG. 5C. In the embodiment shown in FIG. 5A, a diversion device 56*c* includes an angled unit 62' connectable to the one or more liner sections 12*a-n* for diverting fluid and material flow in different directions. As shown in FIG. 5B, diversion device 56 includes a tee-unit 62". As will be evident to one skilled in the art, the diagrammatic representation of diversion devices 88*a-d* are connectable to one or more liner sections 12*a-n* to redirect flow through water management system 10 as desired and desirable.

Figure 6D:
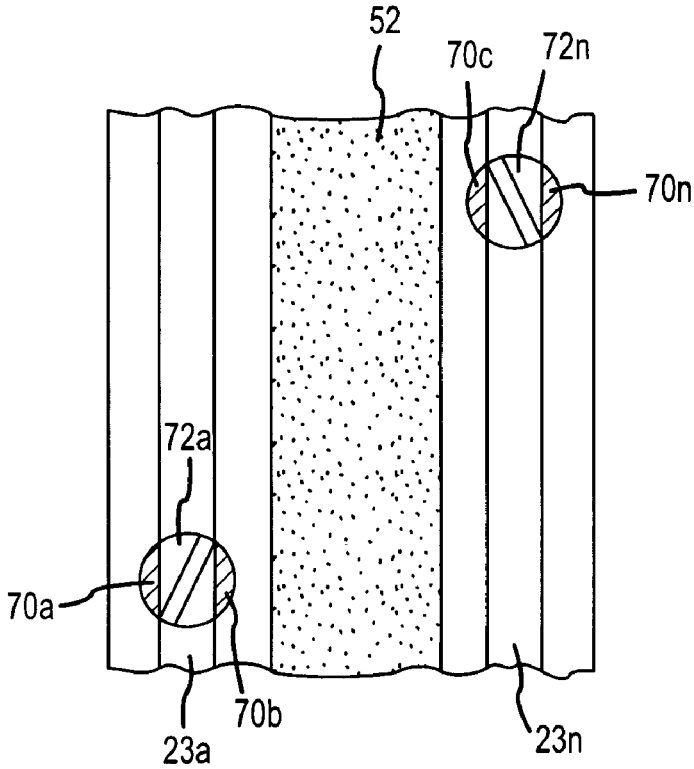
FIG. 6D is a top view of troughs on either side of a foreshortened corrugation as shown in FIG. 6C.
Figure 6E:
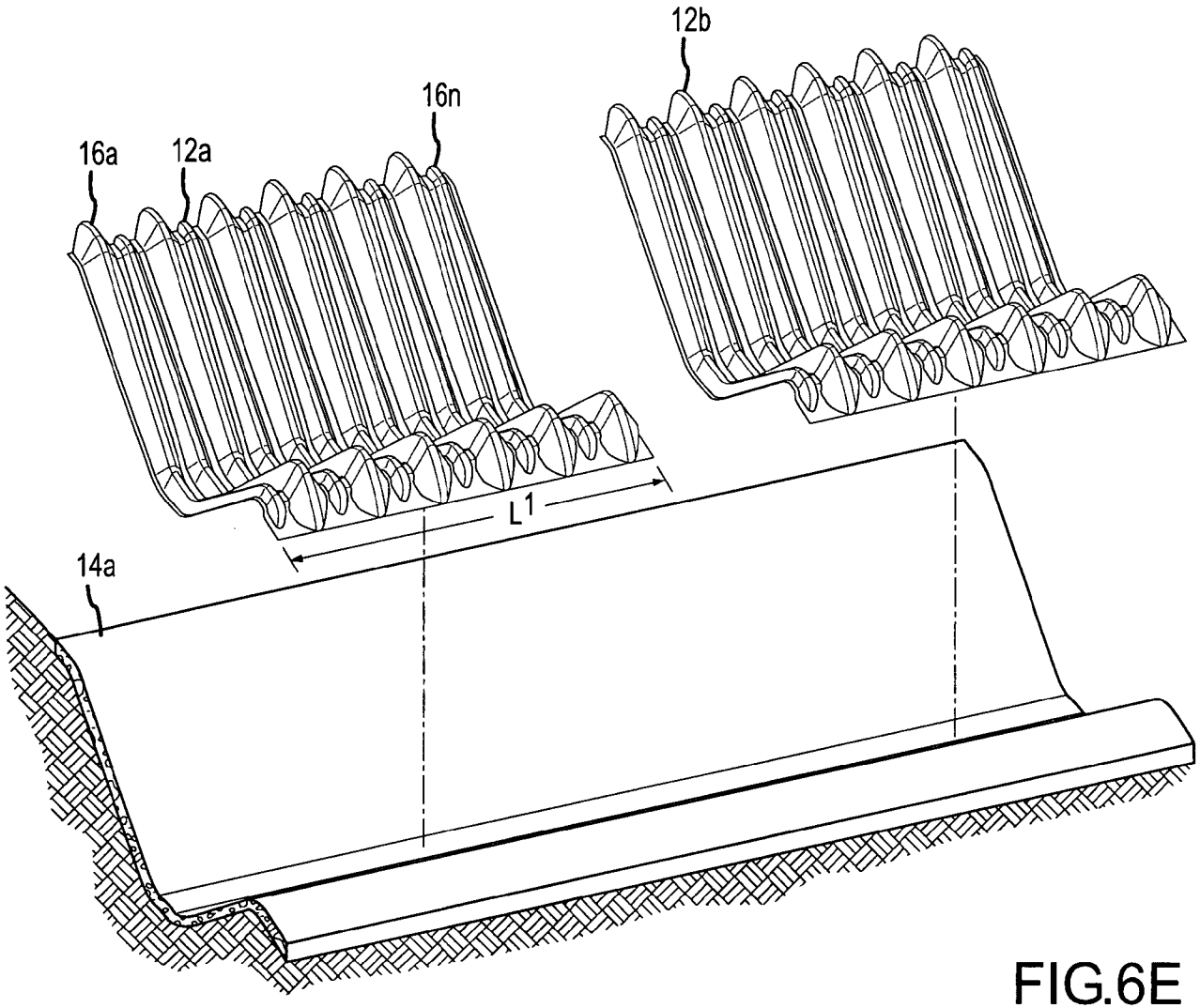
FIG. 6E is a perspective view of two compressibly connectable liner sections to be inserted into a lined ditch.

In yet another aspect of the water management system 10, as shown perhaps best by cross-reference between FIGS. 6B-6D, a plurality of wells 64*a-n* is provided. As shown, wells 64*a-n* are shown in one embodiment as substantially tubular, and formed with an anterior opening 66 and a posterior recess 68. In another embodiment, as also shown by cross-reference between FIGS. 6B-6D, substantially semi-circular channels 70*a-n*, as shown best in FIG. 6C, are formed adjacent wells 64*a-n*. In operation, connector 54 is inserted through wall 34 of liner sections 12*a,b* to assist in connecting liner section 12*a* to liner section 12*b* as shown in FIG. 6E. Wells 64*a-n* provide the mechanical advantage of accommodating the head 72 of connector 54*a* (shown as a threaded rivet) may infix. In addition, the semi-circular channels 70*a-n* may also be formed as shown by cross-reference between FIGS. 6C-6D. The semi-circular channels 70*a-n* provide a segmented annular ledge 74*a-n* against which the lower surface 76 of the head 72 of connector 54*a* comes in contact. The segmented annular ledge 74*a-n* against which the lower surface 76 of the head 72 of connector 54*a* comes in contact is shown diagrammatically by cross-hatched lines in FIG. 6D. The semi-circular configuration of the semi-circular channels 70*a-n* also is shown in FIG. 6D. At least a portion of the head 72 of connector 54*a*, as represented diagrammatically by the dimension $P^1$ in FIG. 6C, is held within semi-circular channels 70*a-b*. As will be apparent to one skilled in the art, wells 64*a-n* and semi-circular channels 70*a-n*, either alone or in combination, provide the mechanical advantage of helping to secure connectors 54*a-n* when installed in liner sections 12*a-n* of water management system 10. As also will become apparent to one skilled in the art, connectors 54*a-n* may be installed in liner sections 12*a-n* either from the top down (namely, through liner section 12*a* into liner section 12*b*), or bottom up (namely, through liner section 12*b* into liner section 12*a*), with or without the formation of wells 64*a-n* or semi-circular channels 70*a-n*.

The water management system shown in drawing FIGS. 1A through 6E includes at least one embodiment, but the embodiments are not intended to be exclusive, but merely illustrative of the disclosed but non-exclusive embodiments. Claim elements and steps in this document have been numbered and/or lettered solely as an aid in readability and understanding. Claim elements and steps have been numbered solely as an aid in readability and understanding. The numbering is not intended to, and should not be considered as intending to, indicate the ordering of elements and steps in the claims. Means-plus-function clauses in the claims are intended to cover the structures described as performing the recited function that include not only structural equivalents, but also equivalent structures. Thus, although a nail and screw may not be structural equivalents, in the environment of the subject matter of this document a nail and a screw may be equivalent structures.

What is claimed is:

1. A water management system, comprising:

a plurality of compressibly connectable liner sections for lining a ditch, wherein the plurality of compressibly connectable liner sections is formed with corrugations;

a plurality of corrugation couplers formed in the corrugations for connecting the plurality of liner sections end-to-end, wherein the plurality of corrugation couplers includes a succession of contiguous extended corrugations and foreshortened corrugations;

means for sealing abutting corrugation couplers;

connector for affixing adjoining corrugation couplers; and an anchoring device insertable through the plurality of compressibly connectable liner sections for securing the water management system in the ditch.

2. A water management system as recited in claim 1, further comprising opposing aprons extending from the compressibly connectable liner sections for reducing erosion and guiding installation of the anchoring device.

3. A water management system as recited in claim 2, wherein the cross-section of the plurality of compressibly connectable liner sections is selected from the group of cross-sections consisting of trapezoids, semi-circles, squares, rectangles, partial squares, partial rectangles, and "V"-shapes.

4. A water management system as recited in claim 3, wherein the extended corrugations include a substantially triangular ridge having a rounded apex.

5. A water management system as recited in claim 4, wherein the foreshortened corrugations include a substantially frustoconical ridge having a planar surface.

6. A water management system as recited in claim 5, wherein a trough contiguously connects the extended corrugations and the foreshortened corrugations.

7. A water management system as recited in claim 6, wherein the means for sealing abutting corrugation couplers is mountable on the planar surface of the substantially frustoconical ridge.

8. A water management system as recited in claim 7, wherein the means for sealing abutting corrugation couplers is a elastically deformable gasket.

9. A water management system as recited in claim 8, wherein the extended corrugations and of the foreshortened corrugations are formed with opposing walls whose slopes are substantially the same.

10. A water management system as recited in claim 9, wherein the length of opposing walls of the foreshortened corrugations would be substantially similar to the dimensions of opposing walls of the extended corrugations if not subtended by the planar surface of the foreshortened corrugations.

11. A water management system as recited in claim 10, wherein the means for sealing further comprises an adhesive placed on the planar surface of the foreshortened corrugations.

12. A water management system as recited in claim 11, further comprising a diversion device.

13. A method for using a water management system, comprising:

selecting a material for forming plurality of compressibly connectable liner sections for lining a ditch;

shaping the material for substantial conformation with the shape of the ditch;

further forming in the material a series of corrugations;

manipulating the corrugations to include a plurality of corrugation couplers having a substantially triangular ridge having a rounded apex and a contiguous substantially frustoconical ridge having a planar surface;

including means for sealing abutting corrugation couplers;

selecting a plurality of connectors formed with a head for affixing adjoining corrugation couplers;

forming a plurality of wells in the liner sections for holding the plurality of connectors; and providing an anchoring device insertable through the plurality of compressibly connectable liner sections for securing the water management system in the ditch.

14. A method for using a water management system as recited in claim 13, wherein the material selecting step includes the substep of selecting polyethylene.

15. A method for using a water management system as recited in claim 13, wherein the material shaping step includes the substeps of shaping the material to form compressibly connectable liner sections having cross-section selected from the group of cross-sections consisting of trapezoids, semi-circles, squares, rectangles, partial squares, partial rectangles, and "V"-shapes.

16. A method for using a water management system as recited in claim 13, wherein the sealing means including step includes the substeps of:

providing an elastically deformable gasket for sealing the plurality of compressibly connectable liner sections mountable on selected corrugation couplers;

shaping the wells to include a plurality of semi-circular channels dimensionally coincident with the head of the connectors for securing the connectors in the compressibly connectable liner sections.

17. A method for using a water management system as recited in claim 13, wherein the anchoring device providing step includes the substep of selecting an anchoring device from among the anchoring devices consisting of rods and earth anchors.

18. A method for using a water management system as recited in claim 13, further comprising the substeps of:

manufacturing the plurality of compressibly connectable liner sections for lining a ditch;

selecting the quantity of compressibly connectable liner sections necessary to construct the water management system;

laying the compressibly connectable liner sections in the ditch;

applying an adhesive on the planar surface of at least one foreshortened corrugations in at least one corrugation coupler at one end of a first compressibly connectable liner section of the plurality of compressibly liner sections;

placing on the planar surface of the at least one foreshortened corrugations in the at least one corrugation coupler at one end of the first compressibly connectable liner section means for sealing abutting corrugation couplers;

lifting from the ditch an adjacent end of a second compressibly connectable liner section;

positioning at least one corrugation coupler in the adjacent end of the second compressibly connectable liner section above the at least one corrugation coupler at the one end of the first compressbily connectable liner;

compressibly connecting the compressibly connectable liner sections end-to-end by applying pressure against the corrugation coupler in the second compressibly connectable liner section;

inserting one or more connectors through the walls of the corrugation connectors for affixing adjoining corrugation couplers;

placing the connected compressibly connectable liner sections in the ditch; and inserting one or more anchors through the connected compressibly connectable liner sections to secure the water management system in the ditch.

19. A method of installing a water management system, comprising:

selecting a material for forming a plurality of compressibly connectable liner sections for lining a ditch;

shaping the material for substantial conformation with the shape of the ditch;

forming in the material a series of corrugations;

manipulating the corrugations to include a plurality of corrugation couplers for connecting the plurality of compressibly connectable liner sections;

choosing a quantity of compressibly connectable liner sections necessary to construct the water management system;

forming a plurality of wells in the liner sections for holding the plurality of connectors;

selecting a plurality of connectors insertable into the plurality of wells for affixing adjoining corrugation couplers;

compressibly connecting one or more of the plurality of compressibly connectable liner sections end-to-end by applying pressure against the plurality of corrugation couplers;

placing the connected compressibly connectable liner sections in the ditch;

inserting one or more connectors through the walls of the corrugation connectors for affixing adjoining corrugation couplers; and inserting one or more anchors through the plurality of compressibly connectable liner sections to secure the water management system in the ditch.

* * * * *